US006017753A

United States Patent [19]

Johnson et al.

[11] Patent Number: 6,017,753

[45] Date of Patent: Jan. 25, 2000

[54] PROCESS FOR THE MANUFACTURE OF METHYL GLUCOSIDE HAVING LOW COLOR AND LOW SUGAR CONTENT

[75] Inventors: Donald L. Johnson; Steven L. Ramsden; Roger E. McPherson, all of Muscatine, Iowa

[73] Assignee: Grain Processing Corporation, Muscatine, Iowa

[21] Appl. No.: 09/179,794

[22] Filed: Oct. 27, 1998

Related U.S. Application Data

[60] Provisional application No. 60/063,677, Oct. 29, 1977.

[51] Int. Cl.[7] ..... C13J 1/00

[52] U.S. Cl. ..... 435/276; 536/18.5; 536/18.6; 536/127

[58] Field of Search ..... 435/267, 274, 435/276; 536/18.5, 18.6, 127

[56] References Cited

U.S. PATENT DOCUMENTS

| | | | |
|---|---|---|---|
| 4,223,129 | 9/1980 | Roth et al. | 536/4 |
| 4,762,918 | 8/1988 | McDaniel, Jr. et al. | 336/127 |
| 4,904,774 | 2/1990 | McDaniel, Jr. et al. | 536/127 |
| 4,959,468 | 9/1990 | Ravi et al. | 536/127 |
| 5,104,981 | 4/1992 | Yamamuro et al. | 536/18.6 |
| 5,270,446 | 12/1993 | Kyogoku et al. | 530/300 |
| 5,696,247 | 12/1997 | Koike et al. | 536/18.6 |

*Primary Examiner*—David A. Redding
*Attorney, Agent, or Firm*—Leydig, Voit & Mayer, Ltd.

[57] ABSTRACT

A process for decolorizing an aqueous solution of methyl glucoside, the solution containing at least one color component and at least one sugar component, is disclosed. The process comprises the steps of providing the aqueous solution of MeG; adding to said solution an amount of yeast or other sugar-converting microorganism sufficient to reduce the level of said sugar component; preferably further adding to the solution an amount of activated carbon sufficient to assist the color component in the solution; and recovering the solution to yield a decolorized, low-sugar solution of MeG. Also disclosed is a process comprising the steps of providing a solution containing MeG and dextrose; and adding to the solution an amount of a sugar-converting microorganism sufficient to reduce the level of the dextrose in the solution. Decolorized MeG solutions prepared by the foregoing processes also are disclosed.

14 Claims, No Drawings

PROCESS FOR THE MANUFACTURE OF METHYL GLUCOSIDE HAVING LOW COLOR AND LOW SUGAR CONTENT

This application claims priority to U.S. patent application Ser. No. 60/063,677, filed Oct. 29, 1997.

TECHNICAL FIELD OF THE INVENTION

The invention is in the field of processes for the preparation of methyl glucoside, and relates more specifically to a process for the preparation of a methyl glucoside solution that has low color and low sugar content.

BACKGROUND OF THE INVENTION

Methyl glucoside (MeG) is an industrial chemical used in the manufacture of various products, including, for example, cosmetics; polyurethane foams; polyether polyols; and etherified or esterified surfactants. MeG also is used as a plasticizer for phenolic, amine, and alkyd resins, in the manufacture of tar-oil varnishes, and for many other industrial purposes. The two isomers of MeG are α-MeG and β-MeG. Both isomers are commercially useful, as are mixtures of α- and β-MeG.

MeG may be prepared by reacting starch with methanol in the presence of a catalytic amount of p-toluene sulfonic acid at elevated temperature and pressure. The starch-methanol reaction produces a mixture of products, which mixture includes α-MeG and β-MeG as predominant species. The methanol can be evaporated and exchanged with water to yield a dark, aqueous solution containing α-MeG and β-MeG in a ratio ranging from about 1.5:1 to 2.5:1 (α-MeG:β-MeG). MeG also may be prepared in a similar glucose-methanol reaction.

The dark color of the solution may interfere with the commercial utilization of the MeG solution, for example, in the manufacture of cosmetics or other personal care products. Accordingly, it is known to decolorize the MeG with a bleaching or whitening agent, such as sodium hypochlorite or sodium borohydride. While such whitening agents are effective in decolorizing the MeG solution, their use may leave undesired residual salts, such as sodium and chloride salts, in the MeG solution. Ionic species such sodium and chloride are undesirable in many commercial applications, such as in the manufacture of polyols for polyurethane foams.

A significant drawback of known methods of decolorizing MeG is that dextrose may remain in the MeG solution, even after decolorization. Dextrose is a natural by-product of the reaction used to prepare MeG. Dextrose will caramelize at high temperature, forming a tannish-brown product. Dextrose also will also discolor under conditions of elevated pH. Thus, although a solution of MeG that has been decolorized with a whitening agent may initially have satisfactory color properties, the color of the MeG solution may degrade upon processing under certain reaction conditions.

It is also known to decolorize α-MeG by crystallizing and separating the α-MeG from solution. This method is expensive and time-consuming, however, and may reduce the yield of α-MeG. Moreover, crystallization of α-MeG may trap impurities within the MeG crystals.

It is a general object of the invention to provide a process for decolorizing a solution of MeG that contains one or more color components and dextrose and optionally, one or more other simple sugar components, to thereby yield a decolorized, low-dextrose MeG solution.

SUMMARY OF THE INVENTION

It has been found, surprisingly, that certain microorganisms such as yeast, or bacteria, such as *Zymomonas mobilis*, may function as sugar-converting microorganisms in connection with the decoloration of MeG and thus may be used to reduce the level of dextrose in an aqueous solution of MeG. Further, while activated carbon is known to be effective in the decolorization of aqueous solutions, it has surprisingly been found that such sugar-converting microorganisms enhance the efficacy of activated carbon in decolorizing solutions containing MeG. Further, it has surprisingly been found that carbon enhances the efficacy of such microorganisms in reducing the level of dextrose in an aqueous solution of MeG. The present invention provides a process for decolorizing a MeG solution that takes advantage of these surprising discoveries, and further provides a decolorized, low-dextrose MeG solution prepared in accordance with the process of the invention.

In accordance with the invention, a sugar-converting microorganism, and preferably activated carbon, are added to a solution of MeG that contains at least one color component and at least one simple sugar component. For example, in one embodiment of the invention, a process for decolorizing an aqueous solution of MeG, the solution containing at least one color component and at least one simple sugar component, is provided. The process comprises the steps of providing the aqueous solution of MeG; adding to the solution an amount of the sugar-converting microorganism sufficient to reduce the level of the sugar component; preferably further adding to the solution an amount of activated carbon sufficient to decolorize or remove the color component in the solution; and recovering the solution to yield a decolorized, low-sugar solution of MeG. Preferably, the sugar-converting microorganism is selected from among yeast and *Zymomonas mobilis*. The carbon and microorganism may be added to the MeG simultaneously or sequentially in either order.

In accordance with another embodiment, the process comprises the steps of providing a solution containing MeG and dextrose; and adding to the solution an amount of sugar-converting microorganism sufficient to reduce the level of the dextrose in the solution. Decolorized MeG solutions prepared by each of the foregoing methods also fall within the scope of the present invention.

DESCRIPTION OF THE INVENTION

The starting solution of MeG may be prepared conventionally. In accordance with one embodiment of the invention, the MeG solution is prepared by reacting starch with methanol under reaction conditions sufficient to yield a solution containing α-MeG and β-MeG. Water is added if necessary to provide an aqueous MeG solution. The starch-methanol reaction is described more fully in U.S. Pat. No. 4,223,129, the disclosure of which is hereby incorporated by reference. If desired, the α-MeG produced by the reaction may be separated from the β-MeG, although such separation is not necessary for many commercial applications. MeG is sold under the name MeG P365 by Grain Processing Corporation of Muscatine, Iowa. MeG P365 is a mixture of α-MeG and β-MeG that contains color components.

When the MeG solution has been prepared as described above, the resulting solution will contain at least one color component and at least one simple sugar component. Typically, this solution will have a characteristically black color. With respect to the color components in the solution, the exact composition and proportion of the color components is not known with particularity, but it is believed that these components include unsaturated carbohydrate monomer and/or oligomer by-products. The sugar component of the MeG solution is believed to consist predominantly or exclusively of dextrose. It should be noted that the invention is operative with respect to starting solutions of MeG other than as prepared in accordance with the method previously described. For example, the invention is operative to remove other simple sugar components from a starting MeG solution. By "simple sugar components" is meant those sugars that are fermentable by yeast or are otherwise convertible by a microorganism to non-sugar form.

In accordance with a preferred embodiment of the invention, a sugar-converting microorganism is added to the MeG solution to thereby decolorize the MeG solution, i.e., to reduce the color caused by color components originally present, and to lower the sugar content of the solution. By "microorganism" is meant any eukaryotic or prokaryotic agent that is useful in converting sugars to non-sugar form. Many different commercially available microorganisms may be used in conjunction with the invention, and the preferred microorganisms are selected from among yeasts and bacteria. Many yeasts are considered suitable for use in conjunction with the invention. Commercially available yeasts include, for example, bakers' yeasts and distillers' yeasts. Suitable yeasts may be obtained from Universal Foods, Milwaukee, Wis. and from Fleischmann's Yeast, Summit, Wash. The microorganism may additionally or alternatively comprise a bacterial species. It is contemplated that any suitable bacterial species may be used in conjunction with the invention. The preferred species is the bacterium *Zymomonas mobilis*. It is contemplated that other microorganisms can be employed in conjunction with the invention, such as, suitable enzymes or other bio-active agents.

The yeast or other suitable microorganism may be added to the solution in an amount sufficient to reduce the level of the simple sugar in the MeG solution. Preferably, the sugar-converting microorganism is added in an amount sufficient to reduce the dextrose and other simple sugars present in the solution to a level of 0.5% by weight or less. Wet bakers' yeast may come in wet or dry forms, the wet forms containing significant amounts of water. It is contemplated that wet yeast may be added in an amount ranging from about 1% to about 15% by total weight of the MeG in the solution, preferably, about 10% by MeG weight.

In accordance with the preferred embodiment of the invention, activated carbon is added to the MeG solution in conjunction with the microorganism. The activated carbon is added in an amount effective to assist the microorganism in decolorizing the MeG solution. Any number of activated carbon products, such as wood-derived and coal-derived carbon, may be employed in conjunction with the invention. It has been found that wood-derived carbon is more effective than coal-derived carbon in decolorizing solutions of MeG. Two preferred wood-derived activated carbon products are sold under the trademarks NUCHAR SA20 and SA30 by Westvaco, Covington, VA.

The activated carbon may be added in an amount sufficient to substantially decolorize the solution. Preferably, the carbon is added in an amount sufficient to reduce the color of the solution to 1 or below on the Gardner-Hellige Color Scale. For example, it is contemplated that the activated carbon may be added in an amount ranging from about 4% to about 15% by total weight of the MeG in the solution, preferably, about 6% by MeG weight.

The microorganism and carbon may be added to the solution sequentially, in either order of addition, or may be added simultaneously. It is believed that adding the microorganism and carbon simultaneously to the solution will be most effective for decolorizing MeG solutions. In another embodiment of the invention, the initial MeG reaction solution is partially decolorized with activated carbon before being treated with a mixture of sugar-converting microorganism and activated carbon in a final decolorization and incubation step.

Regardless of whether the MeG solution has been pretreated with activated carbon, the microorganism and activated carbon are maintained in the MeG solution at a temperature and for a time sufficient to for the microorganism to reduce the amount of sugar in the solution. For example, the incubation temperature may range from about 25° C. to about 35° C., preferably about 30° C. and the time of incubation preferably ranges from about 1 to about 24 hours. The optimum time and temperature may be determined empirically, depending upon the microorganism chosen. Under these conditions, the activated carbon will substantially decolorize the solution, and the microorganism, it is believed, will metabolize the sugar and convert the sugar to ethanol and carbon dioxide.

After incubation, a solution of MeG is recovered, preferably by filtering the activated carbon and microorganism and recovering the filtrate. The solution may be heated, if desired, to evaporate the alcohol in the solution and to inactivate the microorganism, although such steps normally are not necessary. Upon filtration and recovery of the solution, a low-color, low-sugar solution of MeG will be provided. By "low-sugar" is meant low in simple sugars, i.e., sugars that are fermentable or otherwise convertible by the microorganism employed in conjunction with the invention. The retentate may include activated carbon and active microorganism, and may itself be used in a subsequent decolorization process.

The following examples illustrate preferred embodiments of the present invention, but should not be construed as limiting the scope of the invention.

EXAMPLE 1

A starting solution of MeG having the following properties was provided:

| | |
|---|---|
| Gardner-Hellige Color | 2 |
| Solution absorption color (470 nm) | 0.137 |
| Solids | 52.4% |
| Dextrose | 1.9% |

The solution was obtained by partially decolorizing the reaction product of a starch-methanol reaction with activated carbon. Solution absorption color was evaluated by measuring the ratio of the absorbence ($cm^{-1}$) to the decimal solids content of the solution.

To 3612 g of this starting solution was added 180.6 g RED STAR CRUMBLED BAKERS' YEAST. The resulting suspension was agitated vigorously and set into a waterbath at 30° C. for twenty hours. To this suspension was added 108 g activated carbon (NUCHAR SA30, Westvaco). The system was agitated vigorously and set into a waterbath at 30° C. for two additional hours.

To recover the decolorized MeG solution, No. 3 Whatman filter paper was placed on a Buchner filter and was precoated with an aqueous slurry of Celatom Diatomite CO-1 Filter Aid. The treated MeG solution was decanted onto the filter cake and vacuum-filtered to yield a decolorized solution of MeG.

The solution had the following properties:

| | |
|---|---|
| Gardner-Hellige Color | ≦1 |
| Solution absorption color (470 nm) | 0.0075 |
| Solids | 41.7% |
| Dextrose | 0.018% |

As is evident, the solution color of the solution improved dramatically, and over 90% of the dextrose content of the original solution was eliminated. The Gardner-Hellige color of the solution also improved significantly.

COMPARATIVE EXAMPLE 1

This Comparative Example illustrates the superiority of the invention over decolorization with activated carbon in the absence of a sugar-converting microorganism.

To 3612 g of the starting solution used in Example 1 was added 108 g activated carbon (NUCHAR SA30, Westvaco). The suspension was agitated vigorously and set into a waterbath set at 30° C. for sixteen hours. A decolorized solution was recovered in the same manner as in Example 1.

The decolorized solution had the following properties:

| | |
|---|---|
| Gardner-Hellige Color | ≦1 |
| Solution absorption color (470 nm) | 0.108 |
| Solids | 46.2% |
| Dextrose | 2.1% |

As is evident from the foregoing, the Comparative Example yielded a MeG solution having markedly poorer solution absorption color than that prepared in accordance with Example 1. Moreover, the dextrose content of the MeG solution prepared in accordance with the Comparative Example was high, and thus the color of the solution would be expected to degrade at elevated temperature or pH.

EXAMPLE 2

The filter cake recovered during the filtration step of Example 1 was recovered. This filter cake contained activated carbon and active yeast.

The filter cake was added to an aliquot of the starting MeG solution. The resulting suspension was incubated and filtered.

The filtrate was observed to have excellent color. This Example illustrates that yeast and activated carbon may be added simultaneously to a starting MeG solution to effectuate decolorization of the solution.

EXAMPLE 3/COMPARATIVE EXAMPLE 2

This Example illustrates that yeast helps to remove color, and that carbon enhances the efficacy of the yeast at reducing dextrose in the MeG solution.

MeG P365 was used in preparing the following four systems, each of which is included 100 g dry basis MeG:

| | |
|---|---|
| CONTROL | MeG + Water |
| COMPARATIVE EXAMPLE 2 | MeG + Water + 5 g SA30 Activated Carbon |
| EXAMPLE 3A | MeG + Water + 5 g Wet Yeast |
| EXAMPLE 3B | MeG + Water + 5 g Wet Yeast + 5 g SA30 Activated Carbon |

The four systems were mixed, sealed, and then incubated at 30° C. for 24 hours with gentle agitation. Aliquots were then withdrawn and filtered via 0.45$\mu$ syringe filters. The filtrates were assayed, yielding the folding results.

TABLE A

| | Control | Comparative Example 2 | Example 3A | Example 3B |
|---|---|---|---|---|
| Dry Solids | 44.60% | 44.66% | 43.56% | 42.86% |
| Dextrose | 2.03% | 2.06% | 1.32% | 0.46% |
| Color | 242 | 5.6 | 227 | 5.1 |
| Hellige Color | 15 | 2 | 12 | <2 |

Surprisingly, while the sugar-converting microorganism was effective alone in reducing color of the MeG, the combination of carbon and sugar-converting microorganism was substantially more effective. Moreover, the activated carbon surprisingly was found to assist the microorganism in reducing dextrose.

EXAMPLE 4/COMPARATIVE EXAMPLE 3

The comparisons shown in this Example illustrate the surprising observations that 1) *Zymomonas mobilis* helps to remove color and 2) carbon enhances the efficacy of the *Zymomonas mobilis* at reducing dextrose.

MeG P365 was used in preparing the following four systems each of which included 80 g dry basis MeG:

| | |
|---|---|
| CONTROL | MeG + Water |
| COMPARATIVE EXAMPLE 3 | MeG + Water + 4 g SA30 Activated Carbon |
| EXAMPLE 4A | MeG + Water + 4 g Wet *Zymomonas mobilis* |
| EXAMPLE 4B | MeG + Water + 4 g Wet *Zymomonas mobilis* + 4 g SA30 Activated Carbon |

The four systems were mixed, sealed, and then incubated at 30° C. for 24 hours with gentle agitation. Aliquots were then withdrawn and filtered via 0.22$\mu$ syringe filters. The filtrates were assayed, yielding the following results:

TABLE B

| | Control | Comparative Example 3 | Example 3A | Example 3B |
|---|---|---|---|---|
| Dry Solids | 44.2% | 43.4% | 43.4% | 43.9% |
| Dextrose | 2.06% | 2.11% | 1.95% | 1.77% |
| Color | 186 | 5.8 | 161 | 3.2 |
| Hellige Color | 14 | 2 | 12 | <2 |

*Zymomonas mobilis*, thus was found to be useful in decolorizing the methyl glucoside solution. Once again, the combination of activated carbon and the sugar-converting microorganism was surprisingly effective at reducing both color and dextrose in the solution.

While particular embodiments of the invention have been shown, it will of course be understood that the invention is not limited thereto since modifications may be made by those skilled in the art, particularly in light of the foregoing teachings. For example, the invention is applicable to solutions of other alkyl glucosides, as well as alkyl polyglycosides. The invention further is not limited to the use of yeast or *Zymomonas mobilis*, but rather any suitable sugar-converting microorganism may be employed in conjunction with the invention. It is, therefore, contemplated by the appended claims to cover any such modifications as incorporate those features which constitute the essential features of these improvements within the true spirit and scope of the invention.

What is claimed is:

1. A process for decolorizing an aqueous solution of MeG, the solution containing at least one color component and at least one simple sugar component, the process comprising:

providing said aqueous solution of MeG;

adding to said solution an amount of yeast sufficient to reduce the level of said simple sugar component;

adding to said solution an amount of activated carbon sufficient to assist said yeast in decolorizing said color component; and recovering said solution to yield a decolorized, low-sugar solution of MeG.

2. A process according to claim 1, wherein said yeast and said carbon are added to said MeG solution sequentially in either order.

3. A process according to claim 1, wherein said yeast and said carbon are added simultaneously.

4. A process according to claim 1, wherein said simple sugar component includes dextrose, said dextrose being present in said MeG solution in an amount greater than about 0.5% by weight.

5. A process according to claim 4, said process providing a solution containing less than 0.5% dextrose.

6. A decolorized, low-dextrose MeG solution prepared in accordance with the process of claim 5.

7. A process for reducing the amount of dextrose present in a solution of MeG, the process comprising the steps of:

providing a solution containing MeG and dextrose; and adding to said solution an amount of yeast sufficient to reduce the level of said dextrose in said solution.

8. A process for preparing a decolorized MeG solution, the process comprising:

providing starch and methanol;

reacting said starch with said methanol under conditions sufficient to yield a solution comprising MeG, at least one color component, and at least one simple sugar component;

replacing at least a portion of the methanol in said solution with water to provide an aqueous solution;

adding to said solution an amount of yeast sufficient to reduce the level of said simple sugar component;

adding to said solution an amount of activated carbon sufficient to assist said yeast in decolorizing said color component; and recovering said solution to yield a decolorized, low-sugar solution of MeG.

9. A process according to claim 8, wherein said simple sugar component includes dextrose.

10. A decolorized, low-dextrose MeG solution prepared in accordance with the process of claim 9.

11. A process for decolorizing an aqueous solution of MeG, the solution containing at least one color component and at least one simple sugar component, the process comprising:

providing said aqueous solution of MeG;

adding to said solution an amount of a sugar-converting microorganism sufficient to reduce the level of said simple sugar component;

adding to said solution an amount of activated carbon sufficient to assist said sugar-converting microorganism in decolorizing said color component; and recovering said solution to yield a decolorized, low-sugar solution of MeG.

12. The process according to claim 11, wherein said sugar-converting microorganism is a bacterium.

13. The process according to claim 12, wherein said bacterium is *Zymomonas mobilis*.

14. A process for reducing the amount of a simple sugar present in a solution of MeG, the process comprising the steps of:

providing a solution containing MeG and a simple sugar; and adding to said solution an amount of sugar-converting microorganism sufficient to reduce the level of said sugar in said solution.

* * * * *